US007488207B2

(12) United States Patent
Zheng et al.

(10) Patent No.: US 7,488,207 B2
(45) Date of Patent: Feb. 10, 2009

(54) ELECTRICAL CONNECTORS WITH ANTI-MISMATING STRUCTURE

(75) Inventors: Qi-Sheng Zheng, Kunshan (CN); Jia-Yong He, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/881,072

(22) Filed: Jul. 25, 2007

(65) Prior Publication Data

US 2008/0026640 A1 Jan. 31, 2008

(30) Foreign Application Priority Data

Jul. 25, 2006 (CN) ..... 2006 2 0076017 U

(51) Int. Cl.
*H01R 13/60* (2006.01)

(52) U.S. Cl. ..... 439/541.5; 439/608

(58) Field of Classification Search ..... 439/608, 439/541.5

See application file for complete search history.

(56) References Cited

U.S. PATENT DOCUMENTS

| | | | | |
|---|---|---|---|---|
| 6,520,799 | B1 * | 2/2003 | Cheng et al. | 439/541.5 |
| 6,827,605 | B2 * | 12/2004 | Wu | 439/567 |
| 2003/0162446 | A1 | 8/2003 | Ho et al. | |
| 2005/0101176 | A1 | 5/2005 | Kachlic | |

* cited by examiner

*Primary Examiner*—Truc T Nguyen
(74) *Attorney, Agent, or Firm*—Wei Te Chung

(57) ABSTRACT

An electrical connector for non-USB protocol includes an insulative tongue plate portion and a vertical portion extending perpendicularly from a lateral edge of the tongue plate portion. The width of the tongue plate portion extending along a transverse direction is much shorter than what of a corresponding standard USB connector. The thickness of the tongue plate portion extending in a vertical direction perpendicular to the transverse direction is the same as what of a corresponding standard USB connector. Under this circumstance, tongue plate portion and the vertical portion can be easily manufactured by a little improvement of the existing USB mold.

18 Claims, 10 Drawing Sheets

ELECTRICAL CONNECTORS WITH ANTI-MISMATING STRUCTURE

BACKGROUND OF THE INVENTION

1. Field of the Invention

The present invention relates to electrical connectors, and more particularly to electrical connectors with anti-mismating structure for preventing standard USB plugs inserted therein.

2. Description of Related Art

Nowadays, Universal Serial Bus (USB) interface has been used as a standard input/output interface in variety of apparatus. Accordingly, electrical connectors can be designed to accord with the USB interface in order to transfer USB signals.

FIGS. 9 and 10 show existing USB connectors. In FIG. 9, this USB connector is an existing USB receptacle 300, female connector. In application, the USB receptacle 300 may be mounted on a board of a host device. The USB receptacle 300 presents a type-A USB connector. The USB receptacle 300 includes an insulative receptacle tongue portion 32, four conductive contacts 33 held on a bottom surface of the insulative receptacle tongue portion 32 and a metal shell 34 enclosing the conductive contacts 33 and the insulative receptacle tongue portion 32 to form a receiving cavity 36 formed therebetween. USB signals typically include power, ground (GND), and serial differential data D+, D−. To facilitate discussion, the four conductive contacts 33 are designated with numeral 331, 332, 333 and 334 in turn as shown in FIG. 9. In application, the four conductive contacts 331, 332, 333 and 334 are used to transfer power, D−, D+ and ground signals, respectively.

FIG. 10 shows an existing USB plug 400, male connector. The USB plug 400 also presents a type-A USB connector and is usually disposed in the peripheral device to be inserted into the USB receptacle 300. The USB plug 400 comprises a plug tongue portion 42 with four conductive contacts 43 retained thereon and a metal shell 44 enclosing the plug tongue portion 42 and the four conductive contacts 43. The metal shell 44 touches the insulative plug tongue portion 42 on three of the surfaces thereof except a top surface 46 on which the conductive contacts 43 are supported. Same to assignment of the four conductive contacts 33 of the USB receptacle 300, assignment of the four conductive contacts 43 of the USB plug 400 is contact 431 for power signal, contact 432 for D− signal, contact 433 for D+ signal and contact 434 for GND.

After fully insertion of the USB plug 400 into the receiving cavity 36 of the USB receptacle 300, the conductive contacts 431, 432, 433 and 434 of the USB plug 400 make a physical and electrical connection with the conductive contacts 331, 332, 333 and 334 of the USB receptacle 300, respectively, to transmit/receive signals to/from the host device to the peripheral device.

Under special circumstances, a type of special electrical connectors are needed to transfer signals which are similar to while not compatible to the standard USB signals. The special electrical connectors are similar to the standard USB connectors so that the special electrical connectors can be easily manufactured by a little improvement of the existing USB mold in order to decrease the cost of manufacture. However, since the special electrical connectors are similar to the standard USB connectors, there is a need that the special electrical connectors designed with anti-mismating structures to prevent the standard USB connectors inserted therein.

BRIEF SUMMARY OF THE INVENTION

An electrical connector for non-USB protocol includes an insulative tongue plate portion and a vertical portion extending perpendicularly from a lateral edge of the tongue plate portion. The width of the tongue plate portion extending along the transverse direction is much shorter than what of a corresponding standard USB connector. Meanwhile, the thickness of the tongue plate portion extending in a vertical direction perpendicular to the transverse direction is the same as what of a corresponding standard USB connector. Under this circumstance, tongue plate portion and the vertical portion can be easily manufactured by a little improvement of the existing USB mold in order to decrease the cost of manufacture. Besides, the vertical portion can prevent the standard USB connectors from being inserted in to the electrical connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
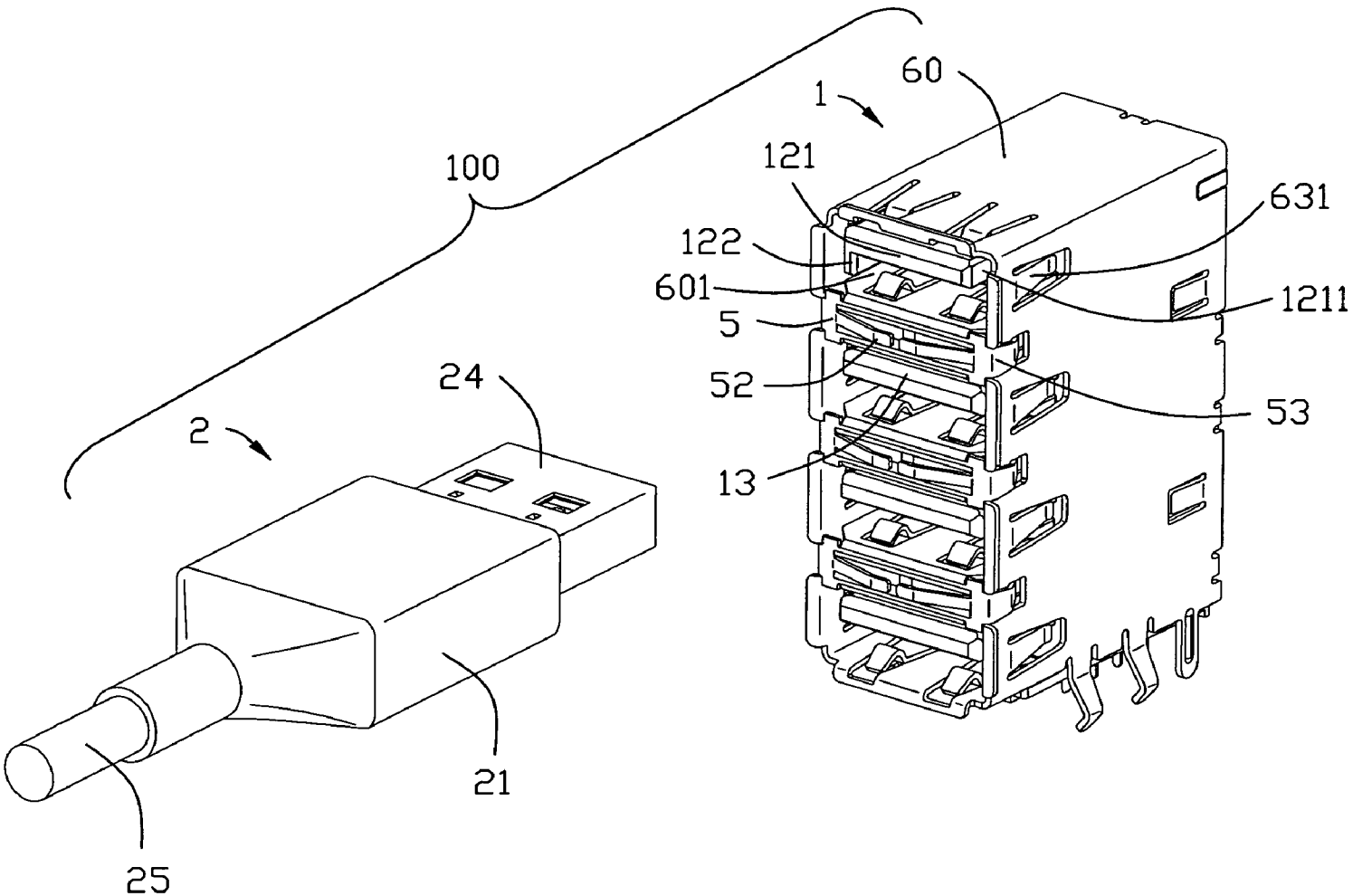
FIG. 1 is a perspective view of an electrical connector assembly showing a status before an electrical plug is inserted into an electrical receptacle according a preferred embodiment of the present invention.

Referring to FIG. 1, an electrical connector assembly 100 includes an electrical receptacle 1 and an electrical plug 2 for mating with the electrical receptacle 1.

Figure 2:
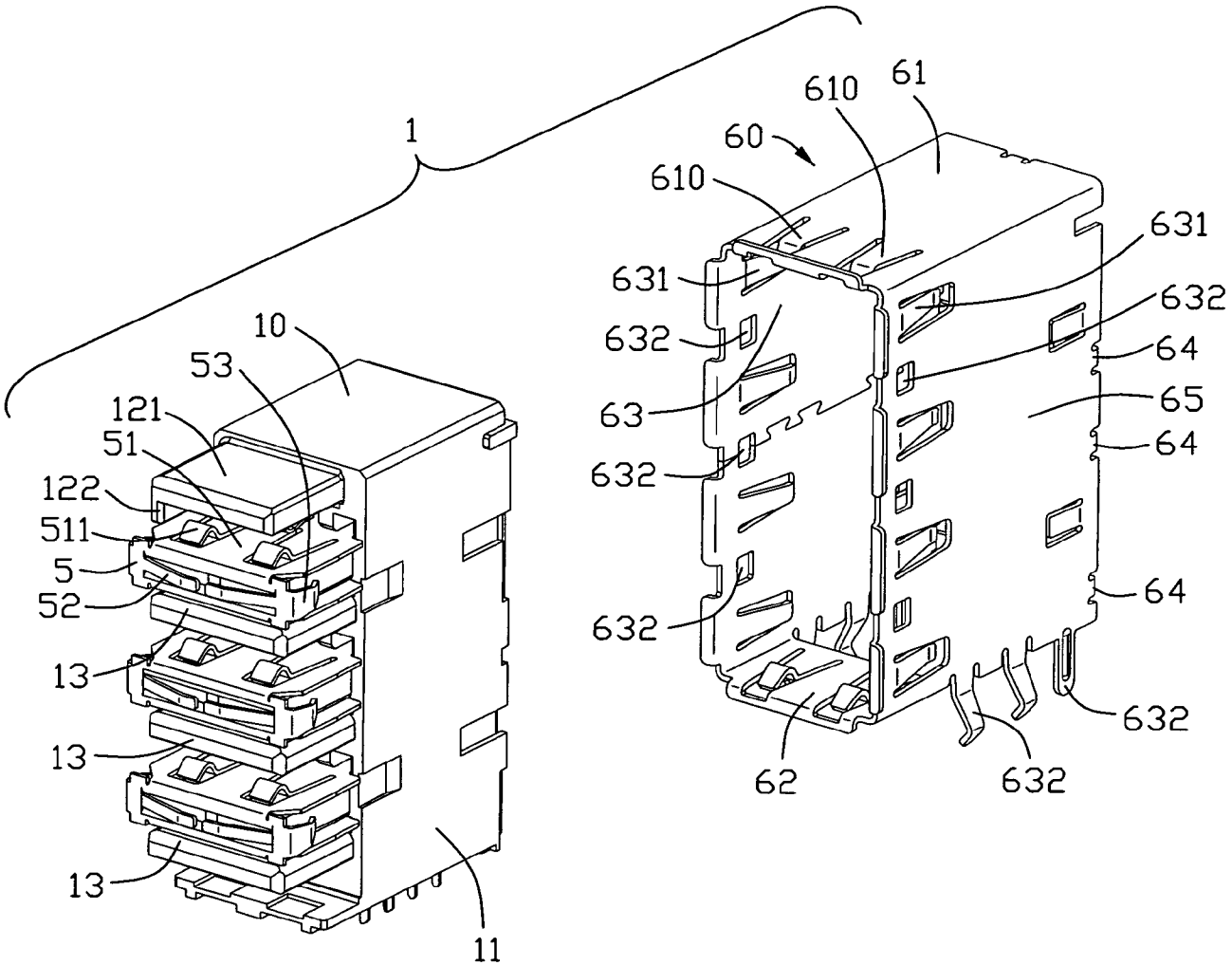
FIG. 2 is a partial exploded perspective view of the electrical receptacle shown in FIG. 1 with a metal shield detached therefrom.
Figure 3:
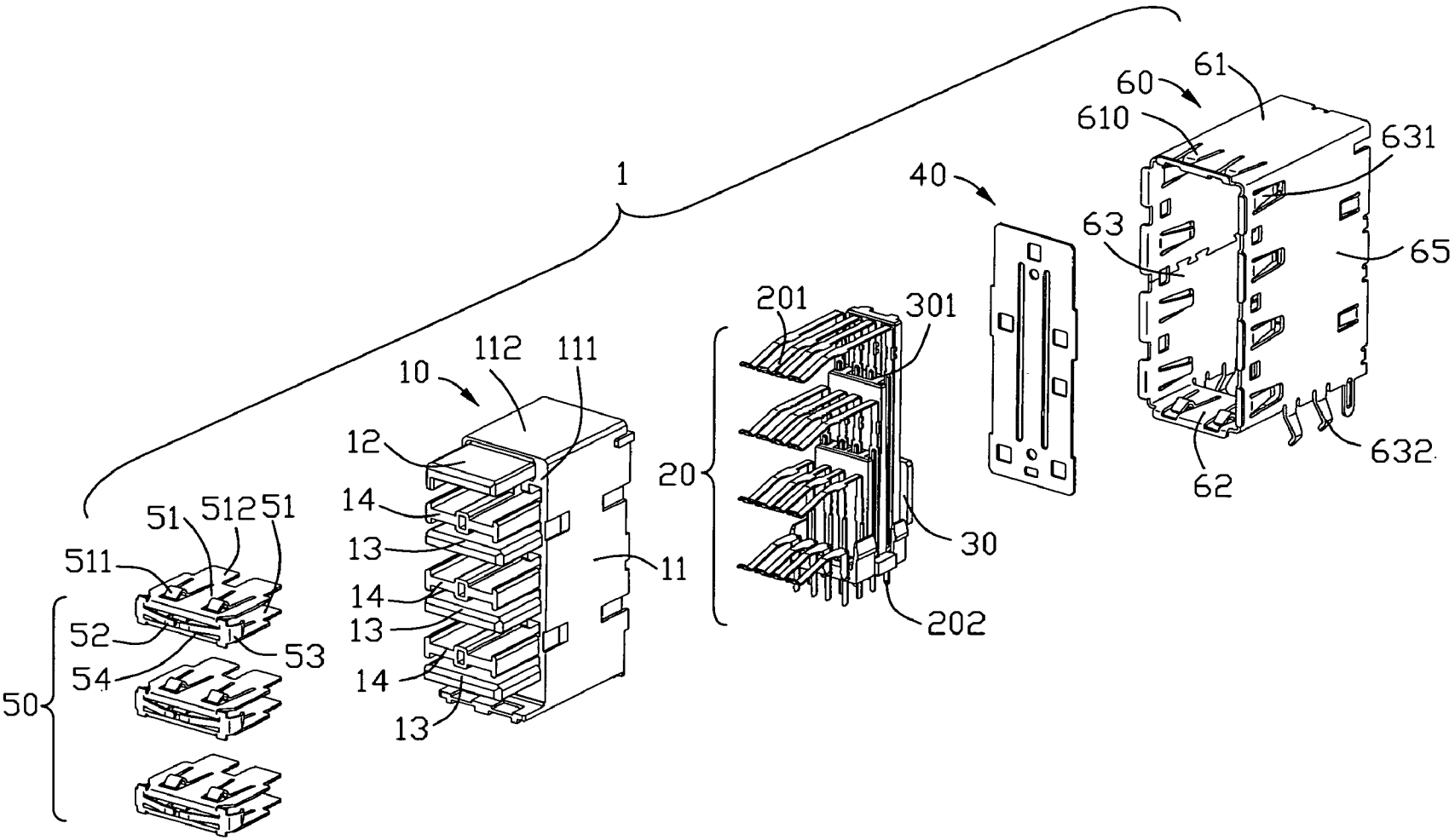
FIG. 3 is an exploded view of the electrical receptacle.
Figure 4:
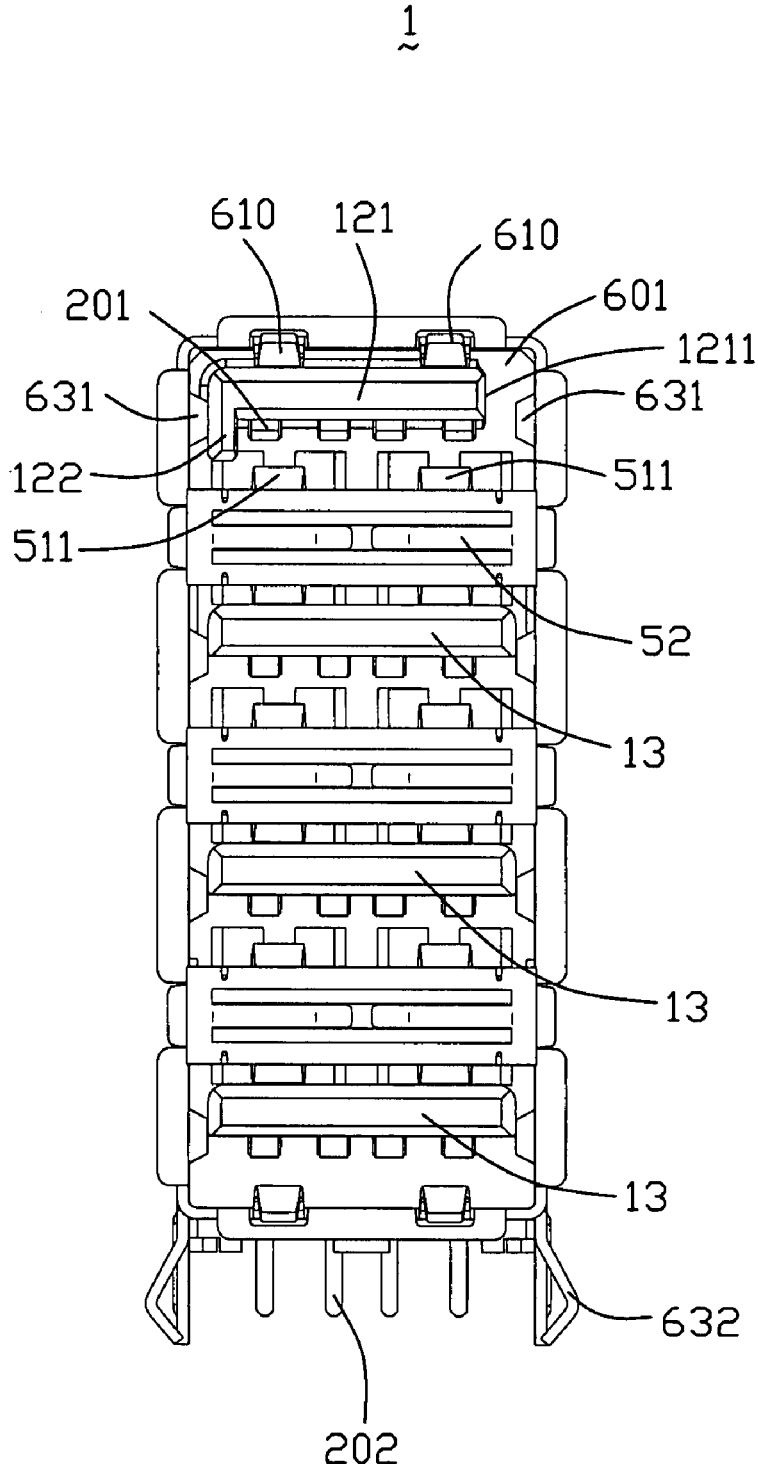
FIG. 4 is a front perspective view of the electrical receptacle shown in FIG. 1.

Referring to FIGS. 2-4, the electrical receptacle 1 in this embodiment is in a stacked manner which includes a first interface, a second interface located under the first interface, and a third interface under the second interface. The second and third interfaces are standard USB type-A interfaces. However, in other embodiments the second or third interfaces can be other interfaces such as IEEE-1394 interface, RJ 45 interface, SATA interface or HDMI interface et al. Of course the electrical receptacle 1 can only set a single first interface which is easy to be made under principle similar to the stacked one.

Referring to FIGS. 2-4, the electrical receptacle 1 includes an insulative housing 10, a plurality of elastic contacts 20 retained in the insulative housing 10, a spacer 30 for restricting the contacts 20, a rear metal shell 40, a plurality of inner metal shells 50 and an outer metal shell 60 enclosing the insulative housing 10. The insulative housing 10 includes a base portion 11, an extending portion 12, a plurality of horizontal mating portions 13 and a plurality of supporting portions 14 disposed between adjacent mating portions 13 and the extending portion 12 in a vertical direction as shown in FIG. 3. The extending portion 12 together with the mating portions 13 and the supporting portions 14 integrally extend forwardly from a front face 111 of the base portion 11 in a longitudinal direction perpendicular to the vertical direction. Since the standard USB interface is obvious, so the detailed description is omitted hereinafter. The extending portion 12 includes a horizontal tongue plate portion 121 parallel to the mating portions 13 and a vertical portion 122 extending from a lateral edge of the tongue plate portion 121. The vertical portion 122 extends downwardly and perpendicularly to the tongue plate portion 121. The thickness of the tongue plate portion 121 is substantially equal to that of the mating portion 13. While the width of the tongue plate portion 121 extending in a transverse direction perpendicular to the vertical direction and the longitudinal direction is shorter than that of the mating portion 13. The tongue plate portion 121 further defines a plurality of passageways (not shown) on a bottom surface thereof for receiving corresponding contacts 20.

Regarding FIG. 3, each of the plurality of contacts 20 includes a contact portion 201 supported by the tongue plate portion 121 and the mating portion 13, and a tail portion 202 extending through through holes 301 of the spacer 30. The contact portion 201 is elastic and extends downwardly beyond the bottom surface of the tongue plate portion 121. The contact arrangement of the first interface is the same as that of the second and third interface as best shown in FIG. 4. In detail, the configuration of each contact 20 located in the first interface is the same as that of standard type-A USB contacts (not labeled) located in the second and third interfaces. Besides, the passageways defined in the tongue plate portion 121 are the same as that of the mating portion 13 as well. As a result, the extending portion 12 can be easily manufactured by a little improvement of the existing type-A USB mold.

Referring to FIGS. 2-3, each inner shell 50 includes a front wall 54, a pair of retaining springs 53 extending rearwardly from right and left edges of the front wall 54, and a pair of top and bottom walls 51 extending rearwardly from top and bottom edges of the front wall 54. The front wall 54 forms a pair of spring arms 52 stamped outwardly therefrom. Each of the top and bottom walls 51 forms a pair of sparing arms 511 stamped outwardly therefrom and a pair of engaging portions 512 for being pressed into the base portion 11. The inner shells 50 are mounted to the supporting portions 14 from a front side of the insulative housing 10.

Regarding FIGS. 1-4, the outer metal shell 60 encloses the insulative housing 10 to form a top cavity 601 for receiving the electrical plug 2. The outer metal shell 60 comprises a top wall 61, a bottom wall 62 opposite to the top wall 61 and a pair of first and second side walls 63, 65 connecting the top and bottom walls 61, 62. The top wall 61 defines a pair of engaging arms 610 protruding into the receiving cavity 601 for abutting against the electrical plug 2. Each of the first and second side walls 63, 65 comprises a spring 631, 651 extending laterally into the receiving cavity 601 for abutting against the electrical plug 2 as well. The first and second side walls 63, 65 further include a plurality of board locks 632 on bottom edges thereof to be received through holes of a circuit board (not shown). The outer metal shell 60 defines a plurality of clips 64 formed on rear edges thereof for abutting against the rear metal shell 40 so that the rear metal shell 40 can be combined with the outer metal shell 60. When the top inner metal shell 50 is assembled to the corresponding supporting portion 14, the sparing arms 511 formed on the top wall 51 thereof extends upwardly into the receiving cavity 601. The pair of retaining springs 53 are engaged into corresponding through holes 632 of the outer metal shell 60. As a result, the inner metal shells 50 are assembled to the insulative housing 10 and the outer metal shell 60. The tongue plate portion 121 of the extending portion 12 further comprises another edge 1211 opposite to the vertical portion 122. The first and second side walls 63, 65 are parallel to the vertical portion 122 and located adjacent to the vertical portion 122 and the another edge 1211 of the tongue plate portion 121, respectively. A space between the first side wall 63 and the vertical portion 122 along the transverse direction is much shorter than that between the second side wall 65 and the another edge 1211 of the tongue plate portion 121 shown in FIG. 4.

Figure 5:
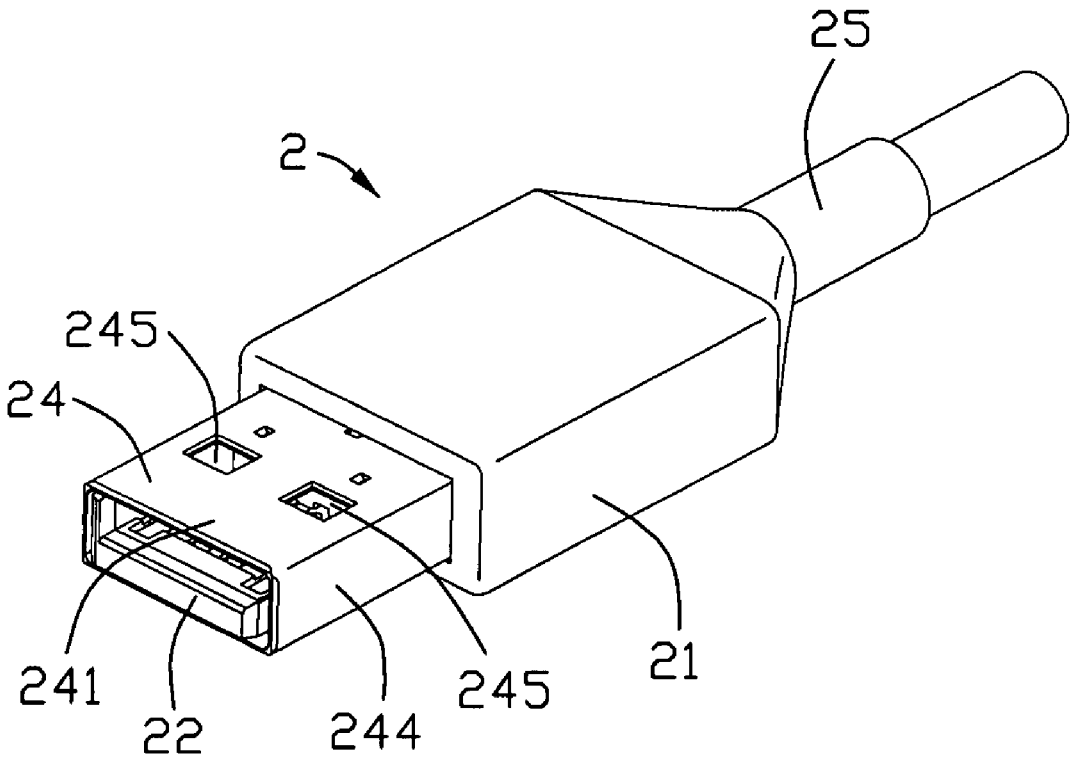
FIG. 5 is a perspective view of the electrical plug shown in FIG. 1.
Figure 6:
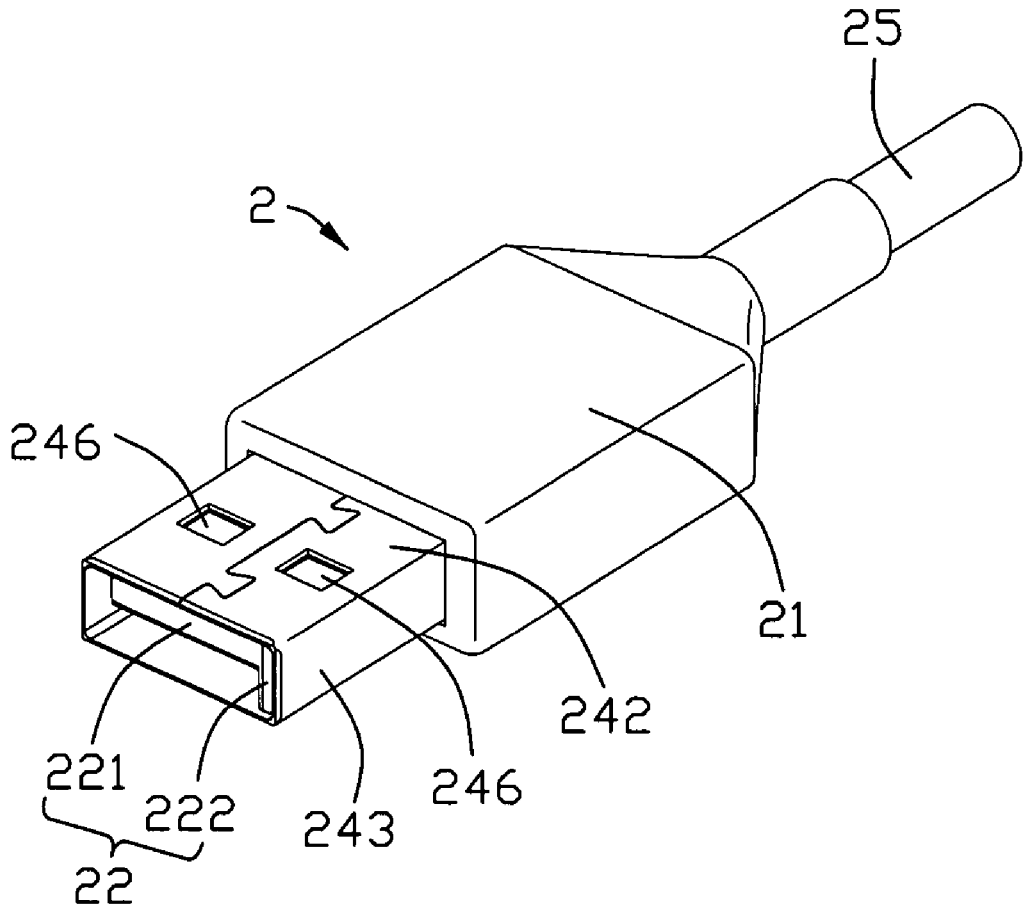
FIG. 6 is a perspective view similar to FIG. 5, while taken from another aspect.
Figure 7:
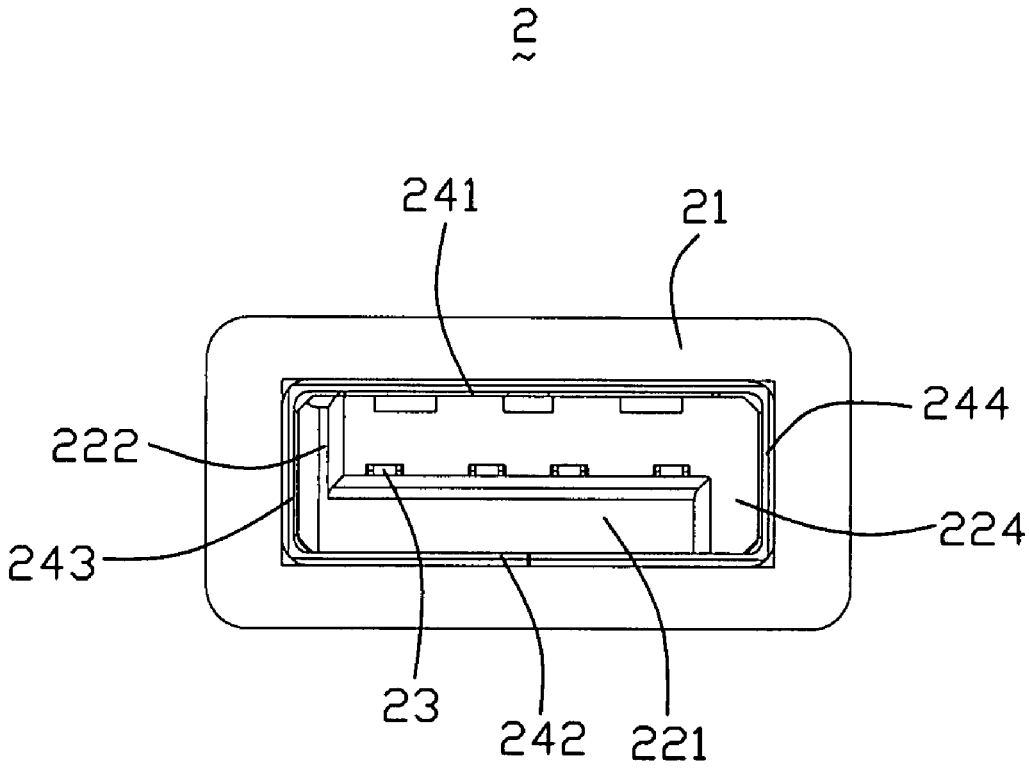
FIG. 7 is a front perspective view of the electrical plug shown in FIG. 5.
Figure 10:
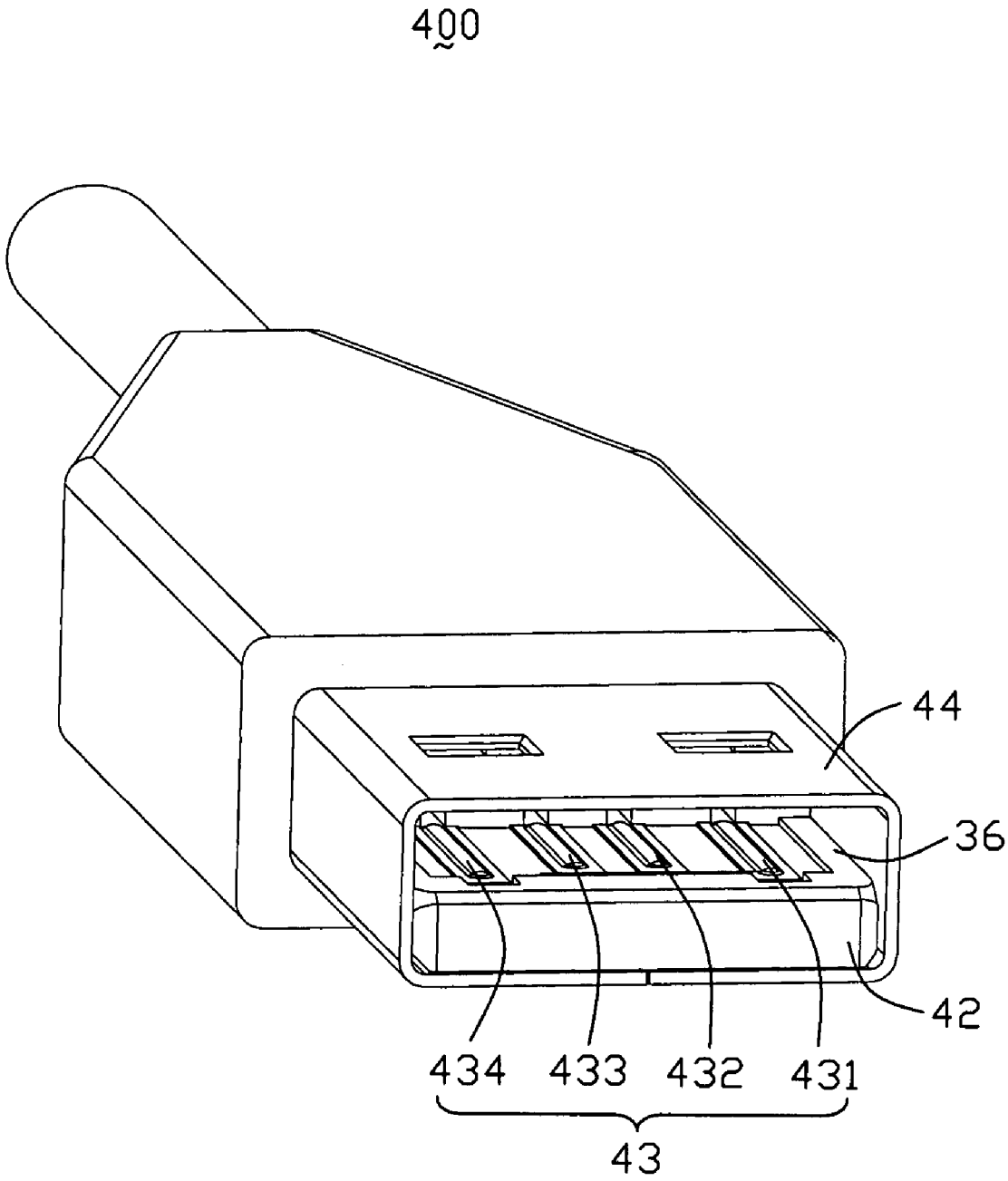
FIG. 10 (PRIOR ART)
FIG. 10 is a perspective view of an existing standard type-A USB receptacle.

Referring to FIGS. 5-7, the electrical plug 2 comprises an interface with a plurality of non-elastic contacts 23, a cable 25 electrically connecting with the contacts 23 and an insulator 21 over molding the interface and the cable 25. The interface comprises a protruding section 22 extending along the longitudinal direction and a metal shield 24 enclosing the tongue plate 22. The contacts 23 comprise a plurality of contact portions (not labeled) supported on the tongue plate 22. The metal shield 24 comprises a top face 241, a bottom face 242 and first and second side faces 243, 244 connecting the top and bottom faces 241, 242. The top and bottom faces 241, 242 define a pair of through holes 245, 246 for engaging with the engaging arms 610 and the sparing arms 511, respectively. The protruding section 22 comprises a horizontal tongue plate 221 and another vertical portion 222 extending upwardly from a lateral edge of the tongue plate 221. The metal shield 24 encloses the tongue plate 22 to form a receiving chamber 224 wherein the top face 241 is positioned on top of the receiving chamber 224. The bottom face 242 and the first side face 243 abut against a bottom surface of the tongue plate 221 and the another vertical portion 222, respectively, as shown in FIG. 7. The thickness of the tongue plate 221 along the vertical direction is substantially equal to that of the plug tongue portion 42 of the standard type-A USB plug (shown in FIG. 10). The width of the tongue plate 221 along the transverse direction is shorter than that of the plug tongue portion 42. Besides, the contact arrangement of the contacts 23 is the same as that of the standard type-A USB plug.

Figure 8:
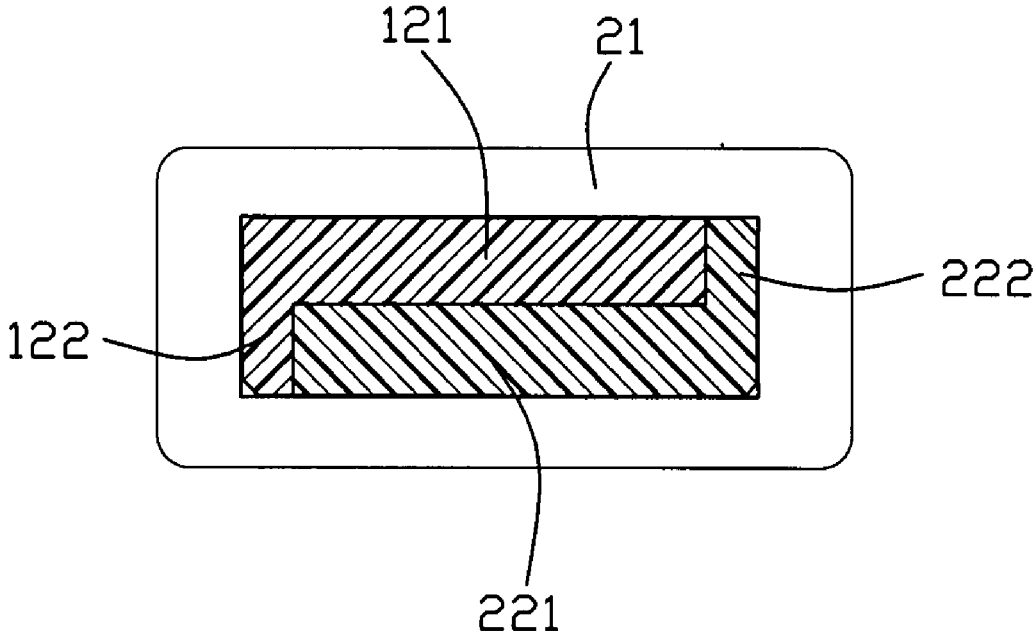
FIG. 8 is a schematic cross-sectional view of the electrical plug inserted into the electrical receptacle showing tongue plates thereof mating with each other with contacts removed therefrom.
Figure 9:
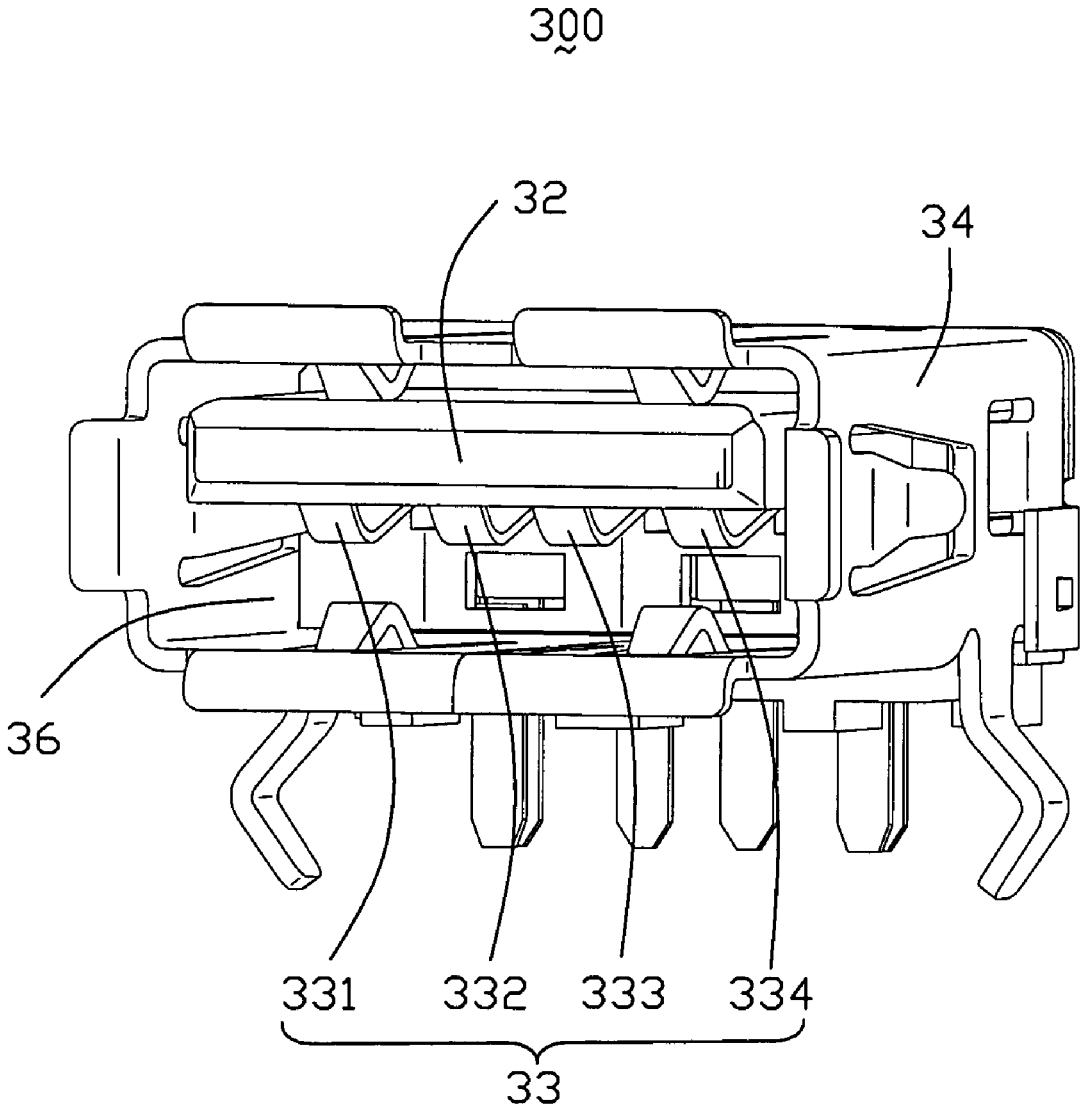
FIG. 9 (PRIOR ART)
FIG. 9 is a perspective view of an existing standard type-A USB plug.

Both of the electrical receptacle 1 and the electrical plug 2 are of non-USB protocol. Referring to FIG. 8, when the electrical plug 2 is fully inserted into the receiving cavity 601 of the electrical receptacle 1, the extending portion 12 of the electrical receptacle 1 and the protruding section 22 mate with each other. Meanwhile, the corresponding contacts 20 of the electrical receptacle 1 electrically connect with the contacts 23 of the electrical plug 2. It is understandable that the standard type-A USB plug 400 can't be inserted into the receiving cavity 601 of the electrical receptacle 1 because the vertical portion 122 abuts against the plug tongue portion 42. It is obvious that the another vertical portion 222 of the electrical plug 2 must abut against the receptacle tongue portion 22 so that the receptacle plug 2 can't be inserted into the standard type-A USB receptacle 300 as well.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical receptacle, comprising:

an insulative housing comprising a base portion and an extending portion protruding forwardly from the base portion in a longitudinal direction, the extending portion comprising a horizontal tongue plate portion and a vertical portion perpendicular to the horizontal tongue plate portion;

a plurality of contacts retained in the insulative housing, each of the contacts comprising an elastic contact portion extending beyond a supporting surface of the tongue plate portion; and a metal shield covering the extending portion and forming a receiving cavity therebetween, the elastic contact portion protruding into the receiving cavity;

wherein a width of the horizontal tongue plate portion is much shorter than that of a standard USB receptacle.

2. The electrical receptacle according to claim 1, wherein the metal shield comprises a top wall restricting the receiving cavity, the top wall defining an engaging arm extending into the receiving cavity.

3. The electrical receptacle according to claim 1, wherein the vertical portion extends from a lateral edge of tongue plate portion.

4. The electrical receptacle according to claim 1, wherein the supporting surface is a bottom surface of the tongue plate portion, the tongue plate portion defining a plurality of passageways recessed from the supporting surface to receive the plurality of contacts.

5. The electrical receptacle according to claim 1, wherein the contacts are for non-USB protocol and a contact arrangement of the contacts is the same as that of the standard USB receptacle.

6. The electrical receptacle according to claim 1, wherein a thickness of the horizontal tongue plate portion is the same as that of the standard USB receptacle.

7. The electrical receptacle according to claim 1, wherein a thickness of the horizontal tongue plate portion along a vertical direction is much thicker than a width of the vertical portion along a transverse direction.

8. The electrical receptacle according to claim 3, wherein the tongue plate portion comprises another edge opposite to the vertical portion, the metal shield comprising a pair of first and second side walls parallel to the vertical portion and being located adjacent to the vertical portion and the another edge of the tongue plate portion, respectively, and wherein a space between the first side wall and the vertical portion along the transverse direction is much shorter than that between the second side wall and the another edge of the tongue plate portion.

9. The electrical receptacle according to claim 8, wherein each of the first and second side wails comprises a spring extending into the receiving cavity.

10. An electrical connector assembly, comprising:

an electrical receptacle comprising:

an insulative housing comprising a base portion and an extending portion protruding forwardly from the base portion in a longitudinal direction, the extending portion comprising a receptacle horizontal tongue plate portion and a receptacle vertical portion perpendicular to the receptacle horizontal tongue plate portion;

a plurality of contacts retained in the insulative housing, each of the contacts comprising an elastic contact portion extending beyond a supporting surface of the receptacle tongue plate portion; and a metal shield covering the extending portion and forming a receiving cavity therebetween; and an electrical plug for being inserted into the receiving cavity of the insulative housing. the electrical plug comprising:

a horizontal plug tongue plate and a plug vertical portion perpendicular to the plug tongue plate;

a plurality of contacts each comprising a contact portion supported by a top surface of the plug tongue plate for abutting against the elastic contact portion of the electrical receptacle; and a plug metal shell enclosing the horizontal plug tongue plate and the plug vertical portion, the plug vertical portion being attached to a side wall of the plug metal shell.

11. The electrical connector assembly according to claim 10, wherein a width of the horizontal tongue plate along a transverse direction perpendicular to the longitudinal direction is much shorter than that of a standard USB plug.

12. The electrical connector assembly according to claim 10, wherein a thickness of the tongue plate is the same as that of a standard USB plug.

13. The electrical connector assembly according to claim 10, wherein the contact portion is non-elastic.

14. The electrical connector assembly according to claim 10, wherein the plug metal shell enclosing the plug tongue plate and the plug vertical portion to form another receiving cavity to receive the receptacle horizontal tongue plate portion and the receptacle vertical portion.

15. An electrical assembly comprising:

a plug connector connected with a cable and including:

an insulative plug housing enclosed by a metallic plug shell;

a plurality of plug contacts disposed in the plug housing;

the plug housing and the plug shell commonly define a plug interface for mating, which has thereon a similar contact arrangement with a standard USB plug connector while having a recessed section on one side of the plug housing and a protruded section on the other side of the plug housing which are different from said standard USB plug connector which essentially defines a flat interface for mating.

16. The electrical connector assembly as claimed in claim 15, further including a receptacle connector including:

an insulative receptacle housing enclosed by a metallic receptacle shell;

a plurality of receptacle contacts disposed in the receptacle housing; wherein the receptacle housing and the receptacle shell commonly define a receptacle interface for mating, which has thereon a similar contact arrangement with a standard USB receptacle connector while having a recessed section on one side of the receptacle housing and a protruded section on the other side of the receptacle housing which are different from said standard USB receptacle connector which essentially defines a flat interface for mating.

17. The electrical connector assembly as claimed in claim 15, wherein the plug shell is metallic and of rectangular configuration, the protruded section of the plug housing being attached to a side wall of the plug shell.

18. The electrical connector assembly as claimed in claim 16, wherein the recessed section of plug connector receives the protrusions of the receptacle connector, and the recessed section of the receptacle connector receives the protrusions of the plug connector.

* * * * *